US005699980A

United States Patent [19]

Balsells Ventura

[11] Patent Number: 5,699,980

[45] Date of Patent: Dec. 23, 1997

[54] MACHINE FOR SPREADING FABRIC

[76] Inventor: Angel Balsells Ventura, Ctra. Nacional II Km. 551.9, 08711 Odena (Barcelona), Spain

[21] Appl. No.: 606,366

[22] Filed: Feb. 23, 1996

[30] Foreign Application Priority Data

Feb. 27, 1995 [ES] Spain ..... 9500375

[51] Int. Cl.[6] ..... B65H 16/10; B65H 29/46

[52] U.S. Cl. ..... 242/564.5; 242/564.3; 270/30.11

[58] Field of Search ..... 242/557, 564.4, 242/564.5; 270/30.04, 30.06, 30.09, 30.11

[56] References Cited

U.S. PATENT DOCUMENTS

| | | | |
|---|---|---|---|
| 608,399 | 8/1898 | Bosca et al. | 242/564.5 |
| 2,058,329 | 10/1936 | Littel | 242/564.5 |
| 4,676,494 | 6/1987 | Smith et al. | 270/30.04 |
| 5,029,827 | 7/1991 | Smith et al. | 270/30.11 |

FOREIGN PATENT DOCUMENTS

| | | |
|---|---|---|
| A-2503113 | 8/1982 | France . |
| A-2857481 | 4/1980 | Germany . |
| A-2 060 724 | 7/1981 | United Kingdom . |
| WO-A-89 04123 | 5/1989 | WIPO . |

*Primary Examiner*—John M. Jillions
*Attorney, Agent, or Firm*—Darby & Darby

[57] ABSTRACT

A machine for spreading fabric. The machine includes a plurality of cylinders for guiding the fabric from the belt and a plate on which the fabric slides from the machine onto a table on which the fabric is spread out. The machine further includes a cylinder for separating the fabric, which cylinder is arranged close to the guide cylinder and is connected kinematically thereto and prevents the fabric from coming into contact with the belts in the area of discharge from the belts. The separating cylinder can be arranged in a substantially vertical position, in a substantially horizontal position or in a downwardly inclined position. The machine may also include a reversing cylinder which is arranged close to the guide cylinder and is kinematically independent thereof. The reversing cylinder enables the rotation of the roll of fabric to be reversed. The machine thus prevents the fabric from getting caught between the feed belts and the guide cylinder, thus avoiding creases and tension, and the drawing of the fabric is thereby facilitated.

8 Claims, 2 Drawing Sheets

MACHINE FOR SPREADING FABRIC

The present invention relates to a machine for spreading fabric from a roll on which the fabric is wound.

PRIOR ART

Machines for spreading fabric from a roll of fabric are known which comprise belts for feeding the wound fabric, a cylinder which guides the fabric and which facilitates the discharge of the fabric from the belts, and a plate on which the fabric slides being guided onto the table on which it is spread out.

The mentioned mechanisms are mounted on a carriage which can be displaced along the table. When displaced, the carriage spreads the fabric out on the table until it reaches the end thereof, where it is cut or a fold is formed by reversing the direction of displacement of the carriage, which spreads a second layer of fabric over the already existing layer, and so on.

The machine can thus spread one or more layers of fabric along the table as appropriate in each particular case of use.

The main problem posed by this type of machine is that the belts form creases in the fabric in the area of discharge from the said belts because the belts for feeding the fabric are separated from one another, with the result that the fabric may become caught between the belts and the guide cylinder.

DESCRIPTION OF THE INVENTION

The machine of the invention overcomes the mentioned disadvantages, and has other advantages which will be described.

The machine of the invention for spreading fabric from a roll on which the fabric is wound is of the type which comprises belts for feeding the wound fabric, a cylinder which guides the fabric and which facilitates the discharge of the fabric from the belts, and a plates on which the fabric slides, being guided onto the table on which it is spread out, and is characterised in that it comprises a cylinder for separating the fabric, which cylinder is arranged close to the guide cylinder and is connected kinematically thereto and prevents the fabric from coming into contact with the feed belts in the area of discharge from the said belts.

This feature prevents the fabric from becoming caught between the feed belts and the guide cylinder, thus preventing creases and tension. Owing to the fact that the fabric-separating cylinder is connected kinematically to the guide cylinder, the drawing of the fabric is facilitated.

Advantageously, the machine of the invention also comprises a reversing cylinder which is arranged close to the guide cylinder and is kinematically independent thereof, which cylinder enables the sense of rotation of the roll of fabric to be reversed. Thus, at the same time as the fabric is prevented from being creased in the area of discharge from the belts, the fabric can be spread by its two faces.

Also advantageously, the separating cylinder is articulated to the cylinder for guiding the fabric, enabling the separating cylinder to be arranged in different positions.

Preferably, the articulation of the separating cylinder is actuated by a motor.

Also preferably, the separating cylinder can be arranged at least in a substantially vertical position with respect to the guide cylinder, in a substantially horizontal position with respect to the guide cylinder or in a downwardly inclined position with respect to the guide cylinder.

In the case of the substantially vertical position, the fabric passes via the separating cylinder without coming into contact with the guide cylinder or with the belts in the discharge area of the fabric. In this manner, the fabric is prevented from becoming caught between the feed belts and the guide cylinder, thus avoiding creases and tension.

In the case of the substantially horizontal position, the fabric passes via the reversing cylinder without coming into contact with the guide cylinder or with the belts in the discharge area of the fabric. In this manner also, the fabric is prevented from coming into contact with the feed belts in the area of discharge from the said belts.

The downwardly inclined position is used when it is not desired to operate the separating cylinder.

Advantageously, the machine of the invention comprises means for detecting the position of the separating cylinder. The movement of the separating cylinder is effected by means of a motor, it being possible to predetermine the desired position. Thee position can be detected by the detecting means.

According to one embodiment, the means for detecting the position of the separating cylinder comprise a magnet arranged on a support which is integral with the separating cylinder, and a plurality of magnetic sensors which detect the presence of the magnet close thereto.

Preferably, the magnetic sensors are arranged in three positions which correspond to the substantially vertical position, the substantially horizontal position and the downwardly inclined position of the separating cylinder with respect to the guide cylinder.

BRIEF DESCRIPTION OF THE DRAWINGS

For a clearer understanding of the above, some drawings are appended which show a practical embodiment diagrammatically and purely by way of non-limiting example.

DESCRIPTION OF A PREFERRED EMBODIMENT

Figure 1:
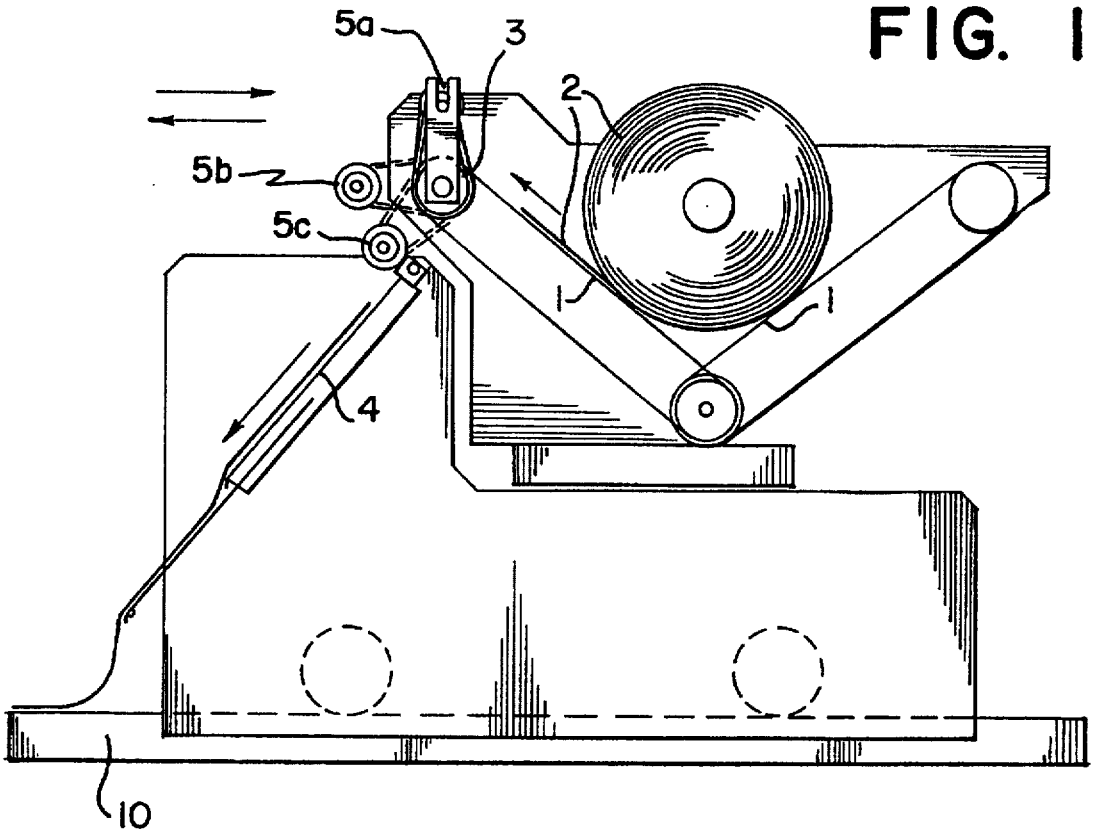
FIG. 1 is a side view of the machine of the invention, showing the three principal operating positions of the separating cylinder.

As can be seen in FIG. 1, the fabric-spreading machine of the invention comprises belts 1 for feeding the wound fabric 2, a cylinder 3 which guides the fabric and which facilitates the discharge of the fabric 2 from the belts 1, and a plate 4 on which the fabric slides, being guided onto the table 10 on which it is spread out. The machine also comprises a cylinder 5 for separating the fabric 2, which cylinder is arranged close to the guide cylinder 3 and is connected kinematically thereto and prevents the fabric 2 from coming into contact with the feed belts 1 in the area of discharge from the said belts 1.

FIG. 1 shows the three positions in which the separating cylinder 5 is arranged: a substantially vertical position 5*a* with respect to the guide cylinder 3, a substantially horizontal position 5*b* with respect to the guide cylinder 3 or a downwardly inclined position 5*c* with respect to the guide cylinder 3. Preferably, the articulation of the separating cylinder is actuated by a motor 10.

Figure 2:
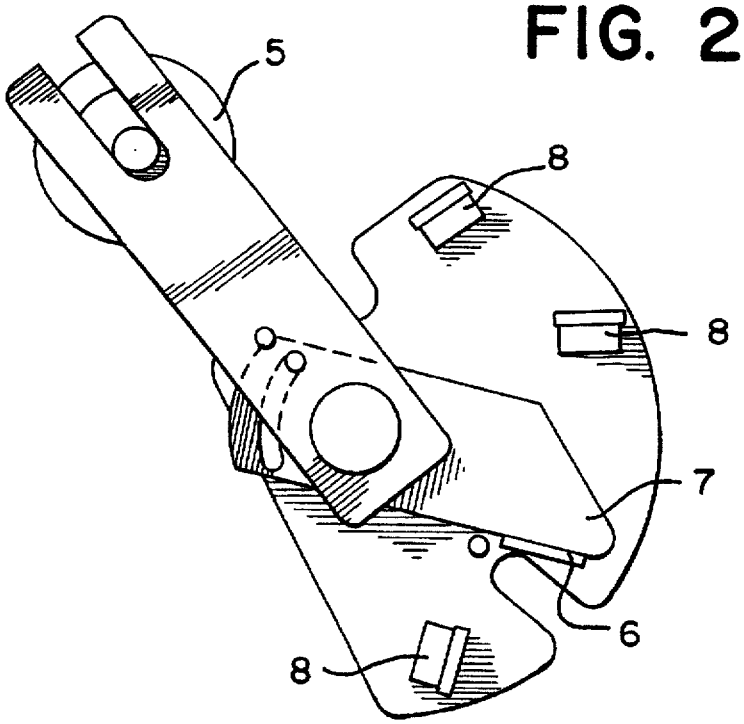
FIG. 2 is a side view of the separating cylinder, the support thereof which includes a magnet, and the three magnetic sensors.

FIG. 2 shows the means for detecting the position of the separating cylinder 5 which comprise a magnet 6 arranged on a support 7, which is integral with the separating cylinder 5, and three magnetic sensors 8 which detect the presence of the magnet 6 close thereto.

The magnetic sensors 8 are arranged in three positions which correspond to the substantially vertical, the substantially horizontal and the downwardly inclined positions of the separating cylinder 5 with respect to the guide cylinder 3.

Figure 3:
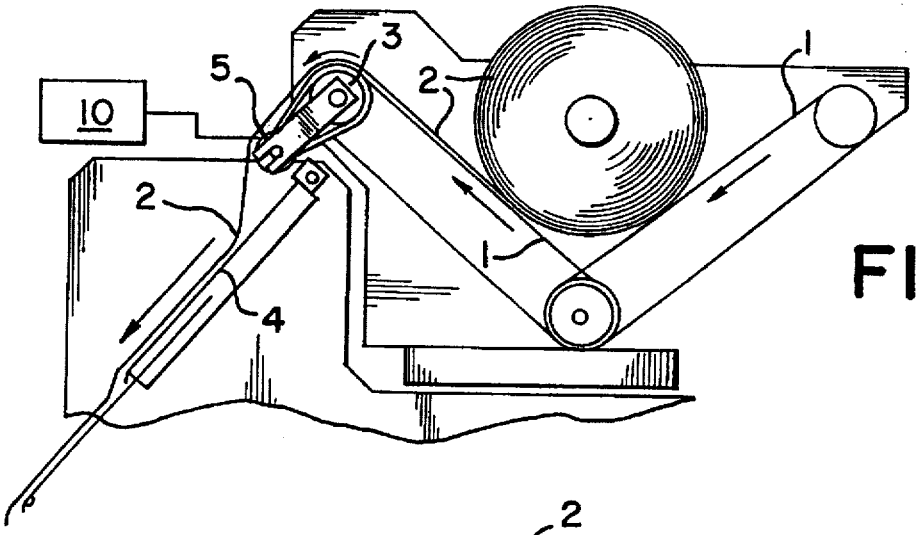
FIGS. 3 to 5 are side views of the machine of the invention with the separating cylinder in its three principal operating positions.
Figure 4:
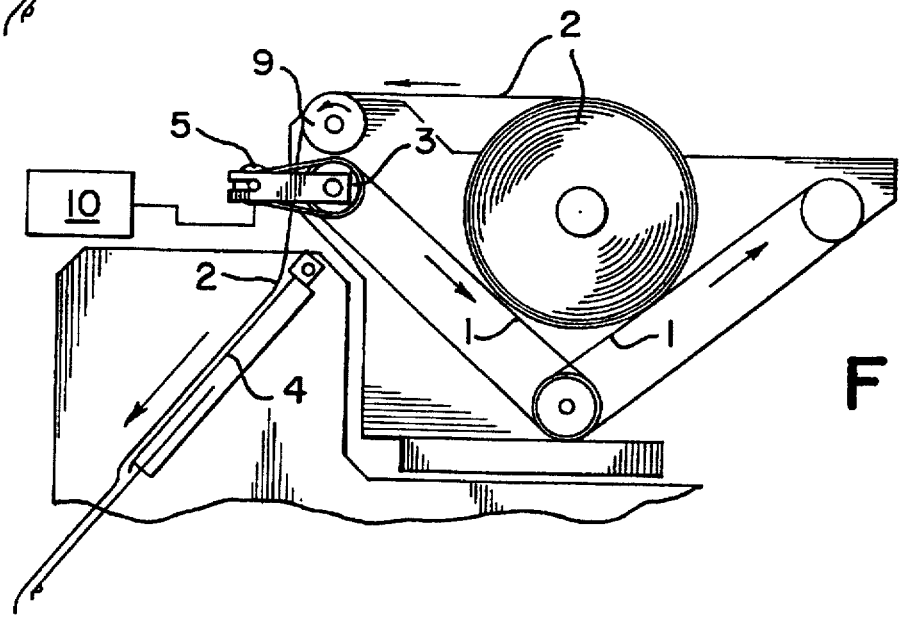
Figure 5:
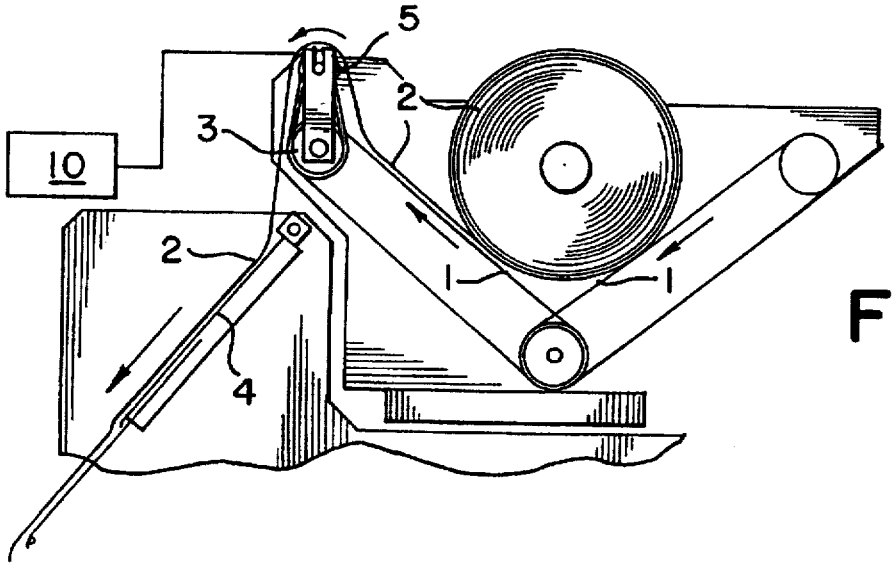

FIGS. 3 to 5 show the three principal positions in which the separating cylinder 5 is arranged.

In FIG. 3, the separating cylinder 5 is in the downwardly inclined position. In this position, the separating cylinder 5 is not in operation, the spreading of the fabric being effected in the customary manner, that is to say, by bringing the fabric into contact with the guide cylinder 3.

In FIG. 4, the separating cylinder 5 is in the substantially horizontal position. This Figure shows the presence of a reversing cylinder 9 which enables the fabric to be spread by the other face, by rotating the roll of fabric 2 in the direction opposite to that in which it rotates in FIG. 3. In this position also, the separating cylinder 5 is not in operation, the spreading of the fabric also being effected in contact with the reversing cylinder 9.

In FIG. 5, the separating cylinder 5 is in the substantially vertical position. In this position the separating cylinder 25 is in operation, preventing the fabric 2 from becoming caught between the feed belts 1 and the guide cylinder 3, thus avoiding creases and tension.

I claim:

1. A machine for spreading fabric from a roll on which the fabric is wound onto a table, said machine comprising:

a plurality of belts;

a guide cylinder which guides the fabric and which facilitates the discharge of the fabric from said belts;

a plate on which the fabric slides to be guided onto the table on which the fabric is spread out; and a separating cylinder for separating the fabric, said separating cylinder being arranged close to said guide cylinder and connected kinematically thereto for movement with respect to said guide cylinder;

wherein said separating cylinder is movable into a position in which said guide cylinder prevents the fabric from coming into contact with said feed belts in the area of discharge from said belts.

2. A machine as in claim 1, further comprising a reversing cylinder arranged close to said guide cylinder and mounted to rotate in a direction opposite the rotational direction of said guide cylinder.

3. A machine as in claim 2, wherein said separating cylinder is articulated to said guide cylinder for guiding the fabric.

4. A machine as in claim 3, wherein articulation of said separating cylinder is actuated by a motor.

5. A machine as in claim 3, wherein said separating cylinder is movable between a substantially vertical position with respect to said guide cylinder, a substantially horizontal position with respect to said guide cylinder, and a downwardly inclined position with respect to said guide cylinder.

6. A machine as in claim 1, further comprising means for detecting the position of said separating cylinder.

7. A machine as in claim 6, wherein said means for detecting the position of said separating cylinder comprise a magnet arranged on a support which is integral with said separating cylinder, and a plurality of magnetic sensors which detect the presence of said magnet.

8. A machine as in claim 7, wherein said magnet sensors are arranged in three positions which correspond to the substantially vertical position, the substantially horizontal position, and the downwardly inclined position of said separating cylinder with respect to said guide cylinder.

* * * * *